US006513593B2

(12) United States Patent
Prasad

(10) Patent No.: US 6,513,593 B2
(45) Date of Patent: Feb. 4, 2003

(54) METHOD AND APPARATUS FOR REDUCING PARAFFIN AND ASPHALTENE DEPOSITS IN PUMPING OIL WELLS

(76) Inventor: Raj K. Prasad, 306 W. Wall, Suite 209, Midland, TX (US) 79701

( * ) Notice: Subject to any disclaimer, the term of this patent is extended or adjusted under 35 U.S.C. 154(b) by 0 days.

(21) Appl. No.: 09/845,634

(22) Filed: Apr. 30, 2001

(65) Prior Publication Data

US 2002/0157832 A1 Oct. 31, 2002

(51) Int. Cl.[7] ..... E21B 36/00

(52) U.S. Cl. ..... 166/302; 166/304; 166/311; 166/57; 166/75.14; 166/242.6

(58) Field of Search ..... 166/304, 244.1, 166/302, 311, 57, 69, 75.14, 242.4, 242.6

(56) References Cited

U.S. PATENT DOCUMENTS 4,401,396 A * 8/1983 McKay
4,422,508 A * 12/1983 Rutledge et al.
4,459,060 A * 7/1984 Patterson
4,475,839 A * 10/1984 Strandberg
4,602,892 A * 7/1986 Brookstein et al.
4,653,953 A * 3/1987 Anderson et al.
4,662,774 A * 5/1987 Morrow
4,672,845 A * 6/1987 Hirsch et al.
RE32,865 E * 2/1989 Rutledge et al.
4,896,725 A * 1/1990 Parker et al.
4,919,560 A * 4/1990 Rutledge et al.

* cited by examiner

*Primary Examiner*—Roger Schoeppel
(74) *Attorney, Agent, or Firm*—Harrison & Egbert

(57) ABSTRACT

An apparatus for reducing paraffin and asphaltene deposits in a pumping oil well including a polish rod having a portion extending outwardly of the earth and having a portion extending into an oil string tubing, a sucker rod string interconnected to the polish rod and extending through the oil string casing into the earth, and an insulating rod interconnected to a lower end of the polish rod and interconnected to an upper end of the sucker rod string. The insulating rod is formed of a material having a thermal conductivity of 0.0167 to 0.06 BTU/(sq. ft.)(hr)(deg.F)(ft). The insulating rod is formed of a body of fiberglass material, an upper connector affixed to the body and formed of a steel material, and a lower connector affixed to the body and formed of a steel material.

20 Claims, 4 Drawing Sheets

METHOD AND APPARATUS FOR REDUCING PARAFFIN AND ASPHALTENE DEPOSITS IN PUMPING OIL WELLS

BACKGROUND OF THE INVENTION

1. Field of the Invention

The present invention pertains to a method and apparatus for controlling and eliminating the deposition and buildup of paraffin and asphaltene deposits on the inside of downhole oil string lines. More particularly, the present invention relates to the use of an insulating rod having low conductivity interposed between the polish rod and the steel sucker rods of an oil well pumping device.

2. Description of the Prior Art

Paraffin and paraffin clogging from deposits in crude oil has long been recognized as a problem in both pumping crude oil from the ground through the downhole oil string and in the transmission of crude oil through oil pipelines. A variety of mechanical, chemical, electrical heating and magnetic systems have been proposed in the prior art for removing paraffin or reducing the affinity of paraffin to deposit or combine with other well effluent so as to result in paraffin clogging of crude oil conduits which as known by those skilled in the oil industry results in significant down time and problem in removing the plugging or clogging of downhole oil strings and above ground flow lines.

The prior art chemical system for removing paraffin plugging of crude oil transmission lines are costly not only in term of the amount of chemicals required to treat downhole oil strings and flow lines. Typical chemical treatments for each oil well range from $150.00 to $600.00 per month per well.

As a result an effective mechanical system for removing or preventing paraffin clogging has been sought in view of cost effectiveness. Unfortunately, many of the prior art mechanical system have not been effective in removing or preventing paraffin clogging or have required an unpractical number of units be placed in the off transmission line, for example, every five to seventy five feet, which make such systems unfeasible in view of cost and the number of units required and in view of space limitations in downhole oil strings which generally have outside diameters of 3 to 4 inches (7.6 to 10.2 cm) and may be as long as 25,000 feet. Other prior art electromechanical systems, which involve heating, are expensive to operate and maintain which has resulted in the predominant use of chemicals and hot oils and solvents.

Typically some of the prior art de-clogging systems employ hot oil, hot water or chemical solvents that are pumped through tubing into the wellbore to either melt or dissolve the paraffin clogs and thus remove accumulations of paraffin, salt and paraffin scale deposits on the inside of the crude oil line from which the crude oil flows. These prior art system result in substantial down time and costs in terms of heating a sufficient amount of water or oil necessary to melt and dissolve paraffin clogged fines as a result of their length and surrounding environmental conditions of the downhole oil line or the surface or buried oil flow transmission lines. Representative of prior art providing for a paraffin removal with the introduction of hot oil or other solvent for the removal of paraffin from clogged lines is U.S. Pat. No. 3,085,629. Consequently, in recent years, chemicals have been preferred in view of their effectiveness.

Chemical or solvent system while effective and widely utilized in the industry are nevertheless costly. As a result a number of other mechanical, electrical and magnetic systems have been proposed for the removal or reduction of the amount of paraffin deposits resulting from the transmission of crude oil. The most pertinent prior art system known pertaining to preventing the buildup of paraffin by attempting to control electrostatic forces by the insulation of the pump and tubing from the well casing and the ground, attributes paraffin accumulates in oil wells as a result of the actions of electric currents resulting from friction between the moving parts of the well pumping machinery. In U.S. Pat. No. 2,368,777 the friction problem is solved by insulating ground with non conductive washers at such points and in such a manner as to prevent the flow of electric current between the parts and the earth. As such various insulation sleeves and washers are provided between the pumping apparatus and the downhole oil string to reduce the effects of friction and the electrostatic forces which are believed to charge particles in the flow line and cause them to deposit on the inside of the crude oil conduit.

U.S. Pat. No. 2,368,777 does not utilize a special coupling in the oil flow line to dissipate and prevent the building up of the electrostatic forces resulting from the flow of crude oil in flow lines or prevent the deposition of paraffin inside above ground flow tines. U.S. Pat. No. 2,368,777 furthermore does not utilize magnets of the combination of materials of different conductivity and magnetivity in accordance with the present invention for the purpose of not only dissipating frictional forces along the section of the pipe but also to magnetically charge the particles of the constituents of crude oil flowing inside the pipe so as to prevent the subsequent deposition of paraffin, salts and paraffin scale deposits further along the downhole oil string or thereafter in the above ground pipeline or flow line.

U.S. Pat. No. 3,222,878 represents the closest prior art uncovered which pertains to the use of magnetic forces for the purposes of controlling the build up of paraffin deposits in above ground flow lines. U.S. Pat. No. 3,222,878 is not applicable to downhole oil lines in view of the size and arrangement of magnets. This patent appears relevant at first glance but is not particularly relevant to the present invention since U.S. Pat. No. 3,222,878 does not electrically isolate sections of pipe either along the downhole oil string or in surface or subsurface oil transmission flow lines and does not disclose a practical system in terms of practicability or in terms of economic feasibility.

U.S. Pat. No. 3,222,878 does not pertain to a downhole device for oil string lines but pertains only to a device for above ground oil flow lines to prevent the deposition of paraffin and diamagnetic deposits including scale since the arrangement of magnets having a radius of $4\frac{5}{16}$th of an inch could not be utilized downhole since it would not fit down inside an oil string casing which typically are 2 or 2½ inches (5.1 to 6.4 cm) in diameter. The above ground magnetic system of U.S. Pat. No. 3,222,878 furthermore does not electrostatically isolate sections of pipe and requires magnets disposed along the length of the pipe from about 10 to perhaps 150 times the length of the magnetic field. The length of the magnetic field described in U.S. Pat. No. 3,222,378 is produced from a magnet of about $5\frac{15}{16}$th of an inch (15.08 cm) in length which therefore would require repeating the installation of the arrangement of magnets every 5 to about 75 feet (1.5 to 22.9 meters) along the length of the pipe. Therefore even if such a mechanical system could be employed downhole it would be far in excess of the $150 to $600 a month per well and as a result of these and other problems such system as U.S. Pat. No. 3,222,878 have generally resulted in the industry not accepting magnets and magnetic system for the control of paraffin.

U.S. Pat. No. 5,052,491, issued on Oct. 1, 1991, to Harms et al, describes an oil tool and method for controlling paraffin deposits which employs the use of magnets to control paraffin accumulation. The preferred application employs at least two magnets having a north pole and south pole aligned in opposite directions and held in place in relation to a magnetic outer shield or casing by a non-magnetic restraining ring. The non-magnetic inside liner or non-magnetic section of flow line in combination with the magnetic shield increases the magnetic field which, in combination with the electrostatic differential in the materials in the coupling in the oil line, prevents and controls paraffin and other substances having the potential for clogging and blocking downhole oil strings. It has been found that this method has been successful in certain crude oil applications but has not worked in other applications.

U.S. Pat. No. 2,368,777, issued on Feb. 6, 1945, to E. F. Price, describes that the main reason for paraffin accumulation in wellbores is the presence of the electric current resulting from friction between the moving parts of the well pumping machinery. In order to reduce electric current, this patent describes the use of non-conductive washers at such points and in such a manner as to prevent the flow of electric current between the moving parts and the earth.

It is an object of the present invention to provide a method and apparatus for minimizing paraffin and asphaltene deposits inside downhole tubing strings.

It is another object of the present invention to provide a low thermal conductivity barrier to heat flow so as to minimize heat loss for the purpose of minimizing paraffin and asphaltene deposits.

It is still a further object of the present invention to provide a method and apparatus which is easy to use, relatively inexpensive, and very effective.

These and other objects and advantages of the present invention will become apparent from a reading of the attached specification and appended claims.

BRIEF SUMMARY OF THE INVENTION

The present invention is a pump apparatus comprising a pumping unit having a head thereon, a polish rod connected to the head of the pumping unit and extending downwardly therefrom, a tubing string having a stuffing box through which the polish rod extends, a single insulating rod (or multiple insulating rods having a length less than 100 feet) connected to a lower end of the polish rod and extending into the tubing, and a sucker rod affixed to an end of the insulating rod opposite the polish rod. The insulating rod preferably has a thermal conductivity of between 0.0167 to 0.06 BTU/(sq. ft.)(hr)(deg.F)(ft). The sucker rod extends into the tubing.

In particular, in the preferred embodiment of the present invention, the polish rod is a steel rod having a connector at a lower end thereof. The insulating rod has a connector at an upper end thereof. The connector of the polish rod is interconnected to the connector of the insulating rod. In particular, a coupling is used which has an internally threaded area at an upper end thereof and an internally threaded area at a bottom end thereof. The internally threaded area of the upper end is affixed to an externally threaded portion at a bottom end of the polish rod. The internally threaded area of the bottom end of the coupling is affixed to an externally threaded portion at a top end of the insulating rod. The insulating rod includes a fiberglass body having a first steel connector at an upper end thereof and a second steel connector at a bottom end thereof. The fiberglass provides the insulating rod with its low thermal conductivity therethrough.

The steel sucker rod has an externally threaded portion at an upper end thereof. A sucker rod coupling is used which has an upper internally threaded area joined to an externally threaded portion at the bottom of the insulating rod. The sucker rod coupling has a lower internally threaded area which is joined to an externally threaded portion of the sucker rod. The sucker rod is connected to a downhole pump.

The tubing and flow line have has an exposed portion extending outwardly of the surface of the earth. An insulating material is affixed around the exposed portion. This insulating material has a thermal conductivity preferably of between 0.0167 to 0.06 BTU/(sq. ft.)(hr)(deg.F)(ft). In particular, this insulating material is fiberglass material which is wrapped around the exposed portion.

The present invention is also a method of reducing paraffin and asphaltene deposits in a pumping oil well comprising the steps of: (1) forming an oil pumping unit having a polish rod connected to a head of a pump unit, (2) affixing a single insulating rod to a bottom end of the polish rod within an oil string tubing; and (3) attaching a steel sucker rod to the end of the insulating rod opposite the polish rod. The insulating rod is formed of an insulating material preferably having a thermal conductivity of between 0.0167 to 0.06 BTU/(sq. ft.)(hr)(deg.F)(ft). In particular, in the method of the present invention, the insulating rod is formed of a fiberglass body. A first steel connector is affixed to one end of the fiberglass body and a second steel connector is affixed to an opposite end of the fiberglass body. The polish rod and the sucker rod are formed of steel material.

DETAILED DESCRIPTION OF THE INVENTION

Figure 1:
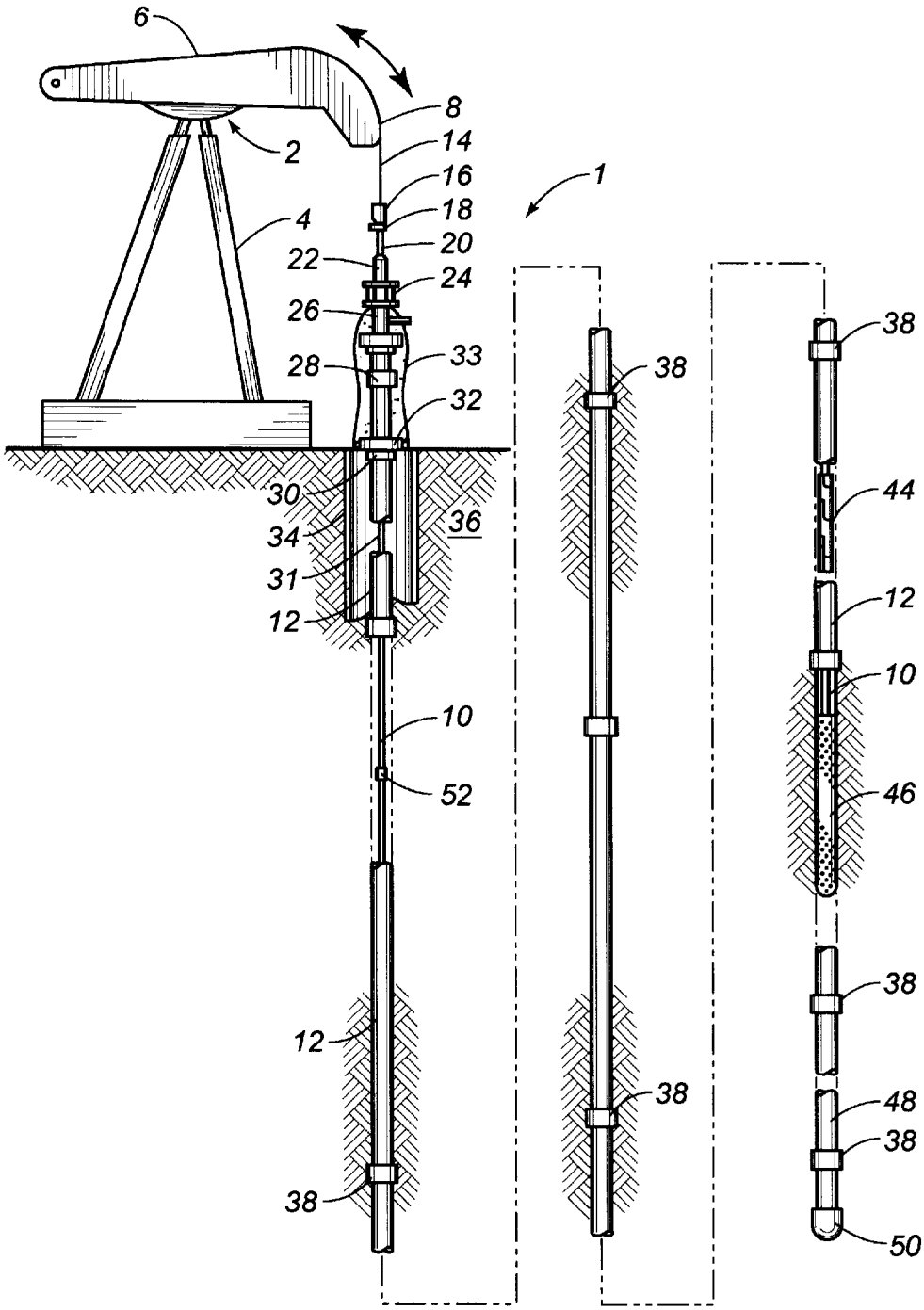
FIG. 1 is an elevational view partly in section of an oil well pumping unit and downhole oil string including the insulating rod in accordance with the teachings of the present invention.

Referring to FIG. 1, there is shown a well known oil pumping unit 1 including the belowground apparatus connected to the above ground apparatus. In particular, an aboveground sampson post 4 has a saddle bearing 2 which supports a walking beam 6 having a horsehead 8 for activating a sucker rod 10 in the downhole oil string tubing 12 through a bridle 14. Bridle 14 is connected to sucker rod 10 through a standard polished rod clamp 16 and carrier bar 18 through polish rod 20 and insulating rod 31. The polish rod 20 extends through the polish rod liner 22 and the stuffing box 24. A pumping tee 26 connects the stuffing box 24 with a pup joint 28 to the tubing head 30 which connects the downhole oil string tubing 12 from its position aboveground to its position below the surface of the earth. An insulating material 33 extends around the pup joint 28 and the casing head 32 and the pumping tee 26 so as to be resistive of temperature changes affecting the oil string casing 12. The insulating material 33 is a wrapping of fiberglass extending therearound. This wrapping of fiberglass has a thermal conductivity of between 0.0167 to 0.06 BTU/(sq. ft.)(hr)(deg.F)(ft).

The casing head 32 caps the surface casing 34 which provides a separation between the surrounding ground 36 and the downhole oil string tubing 12. The downhole tubing 12 predominantly employs downhole oil string pipes that are connected together through couplings. These sections of oil string pipe, which form the downhole oil string tubing have male threads at both ends, are connected utilizing standard couplings 38 for joining the sections of oil string tubing 12 together. The novel insulating rod 31 is connected between the polish rod 20 and the sucker rod 10 so as to prevent paraffin and asphaltene deposits from clogging the inside of the pipe as it is drawn up through the oil string tubing 12. The crude oil is pumped to the surface by the action of walking beam 6 and subsurface pump 44 through the perforated pup joint 46. The downhole string further includes a standard tubing and mud anchor 48 connected to a bull plug 50. It should be noted that some wells may not have the mud anchor 48 or bull plug 50.

Crude oil, containing paraffin and other clogging materials, is pumped to the surface through the perforated pup joint 46 through subsurface pump 44 through the oil string tubing 12 by sucker rod 10 which itself is connected to the subsurface pump 44 through sections of the sucker rod 10 connected with sucker rod couplings 52. The pumping action of the sucker rod 10 coupled with the flow of crude oil through the oil string tubing 12 will produce paraffin and asphaltene deposits on the walls of the casing 12. The clogging of the downhole oil string casing 12 has heretofore required the shutdown and maintenance of the oil well by the introduction of hot oil or solvents being pumped down the oil string casing 12 for a sufficient time and in a sufficient quantity to melt the paraffin clog in the downhole oil string tubing 12. This maintenance is costly in terms of down time, chemicals and energy required to unclog the oil string. This clogging of the oil string can be prevented by simply utilizing the insulating rod 31 between the polish rod 20 and the sucker rod 10. Most oil produced from geologic formations contains higher molecular hydrocarbon chains which produces paraffin and/or asphaltene deposition when subjected to cooling. The cooling in oil wells results from expansion of well fluids due to pressure drop, change in geothermal gradients as fluid moves to higher elevations and change in ambient temperature from day to night or from summer to winter seasons. Such paraffin and/or asphaltene deposits clogs the inside of tubing strings and/or flow pipes which eventually prevents oil production and/or equipment failures such as holes in tubings, sucker rod partings, pump failure and/or plugged flow lines. The present invention utilizes the low thermal conductivity insulating rod 31 on the top of the steel rod strings as a barrier to heat flow so as to minimize heat loss and hence minimize paraffin and asphaltene deposits.

Figure 2:
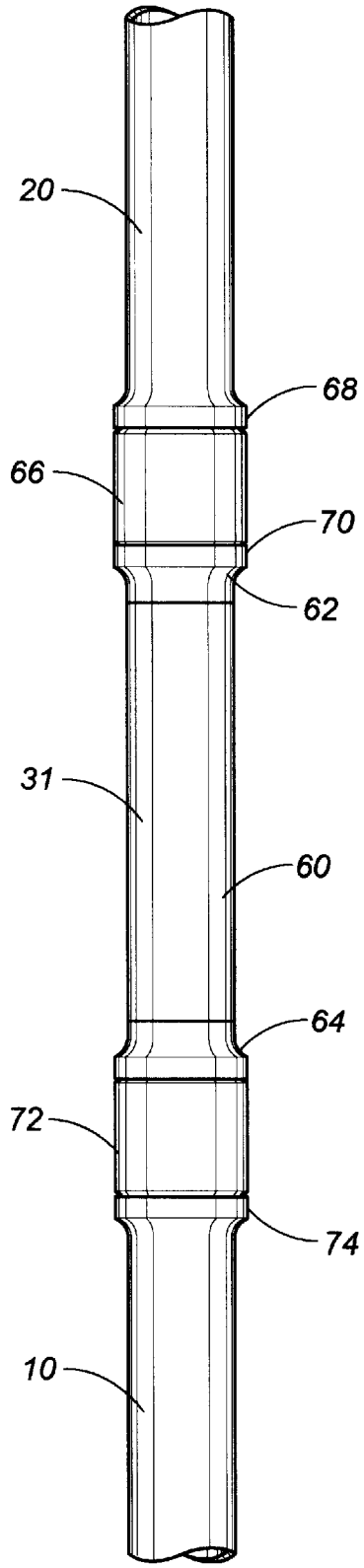
FIG. 2 is a side elevational view of the apparatus in accordance with the teachings of the present invention.

Referring to FIG. 2 there is an isolated view of the polish rod 20, the insulating rod 31 and the top end of the sucker rod 10. The polish rod 20 and the sucker rod 10 are formed of a steel material. The insulating rod 31 is formed of a fiberglass body portion 60 having an upper steel connector 62 and a bottom steel connector 64.

Since the polish rod 20 cannot be directly connected to the insulating rod 31, a coupling 66 is utilized so as to join the lower end 68 of the polish rod 20 to the steel connector 62 at the upper end 70 of the insulating rod 31. The coupling 66 has an upper female connector and a lower female connector (as will be shown in FIG. 4). The upper female connector of the coupling 66 receives the lower male connector at the bottom end 68 of the polish rod 20. Similarly, the lower female connector of the coupling 66 will be joined to the upper male connector of the insulating rod 31. A sucker rod coupling 72 is affixed to the steel connector 64 at the bottom end of the insulating rod 31. Similarly, the sucker rod coupling 72 is affixed to the male connector at the upper end 74 of the sucker rod 10. The sucker rod coupling 72 is similar to the coupling 66 in that the sucker rod coupling 72 has an upper female connector and a lower female connector. The polish rod 20, the insulating rod 31 and the sucker rod 10 are joined with the respective couplings 66 and 72 by standard threading procedures used in the oilfield environment.

The main reason for paraffin accumulation inside the tubing string is the heat loss that causes the temperature to fall below the "cloud point" when well effluent travels from the bottom of the wellbore to the surface. The heat loss occurs through the highly heat conductive steel tubing and steel sucker rod strings 10. Tubing is connected to the flow line. Heat loss through the tubing is minimized by insulating (with common insulating materials such as fiberglass) as shown by wrapping 33 in FIG. 1. The sucker rod string 10 is interconnected to a steel polish rod 20. The steel polish rod 20 has a portion which is exposed to the atmosphere and has high thermal conductivity. The thermal conductivity of sucker rods made out of carbon steel is in excess of 4,000 BTU/(sq. ft.)(hr)(deg.F)(ft.). An effective heat barrier is created by placing the insulating rod 31, formed of a fiberglass material, having a very low thermal conductivity ranging from 0.0167 to 0.06 BTU/(sq. ft.)(hr)(deg.F)(ft) between the steel sucker rods 10 and the polish rod 20. The placement of the fiberglass insulating rod 31on the stop of the steel sucker rod string 10 is very safe since fiberglass rods have very high tensile strength (in the order of 75,000 p.s.i.) similar to the tensile strength of steel sucker rods 10.

Figure 3:
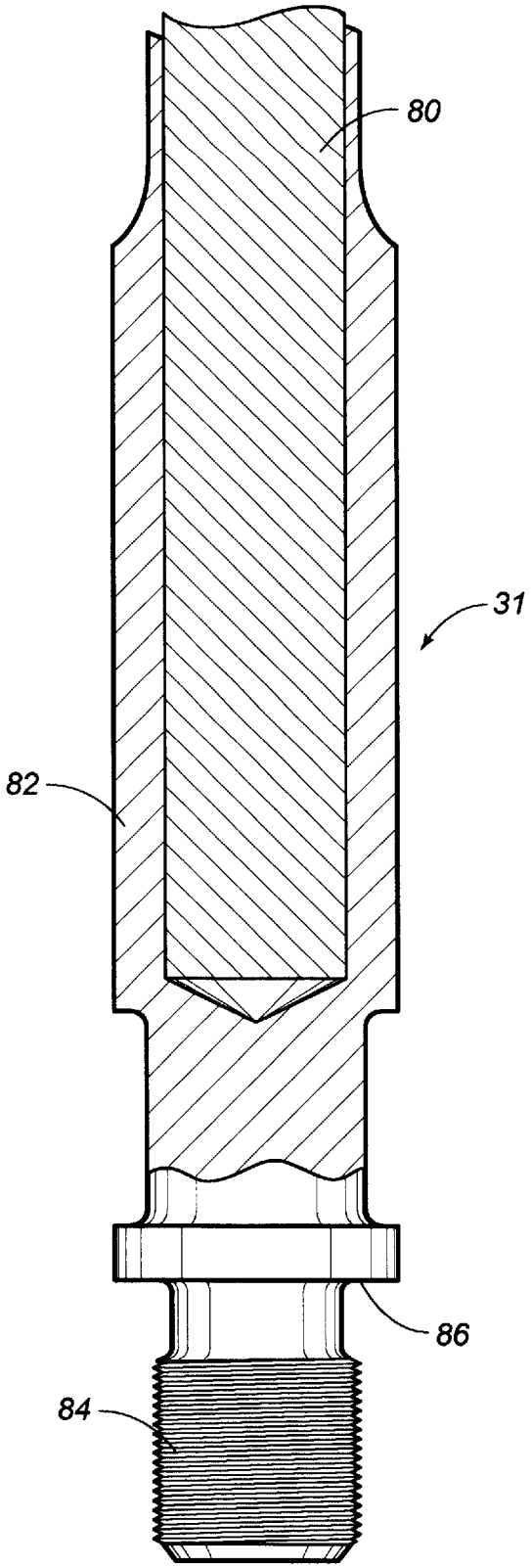
FIG. 3 is a partially cross-sectional view of one end of the insulating rod of the present invention.

FIG. 3 shows a cross-sectional view of one end of the insulating rod 31. The opposite end of insulating rod 31 has an identical configuration. As can be seen, the insulating rod 31 has a main body portion 80 which is formed of a fiberglass material. A steel connector 82 is affixed to the exterior surface of the fiberglass body 80. The steel connector 82 can be adhered by various means to the external surface of the fiberglass body 80. The steel connector 82 has an externally threaded portion 84 at a bottom end thereof. A shoulder 86 is formed so as to extend radially outwardly from the steel connector 82. Shoulder 86 provides an abutment surface when the coupling 72 is threaded around the externally threaded portion 84 and comes into abutment therewith. The diameter of the shoulder 86 should generally match the exterior diameter of the coupling 72. It should be noted that the upper end of the insulating rod 31 has a similar configuration in which a steel connector is affixed to the opposite end of the fiberglass body 80 and has an externally threaded portion, similar to that of threaded portion 84, in a suitable position for being joined to the internally threaded portion of the coupling 66. The fiberglass body 80 has a thermal conductivity of between 0.0167 to 0.06 BTU/(sq. ft.)(hr)(deg.F)(ft).

Figure 4:
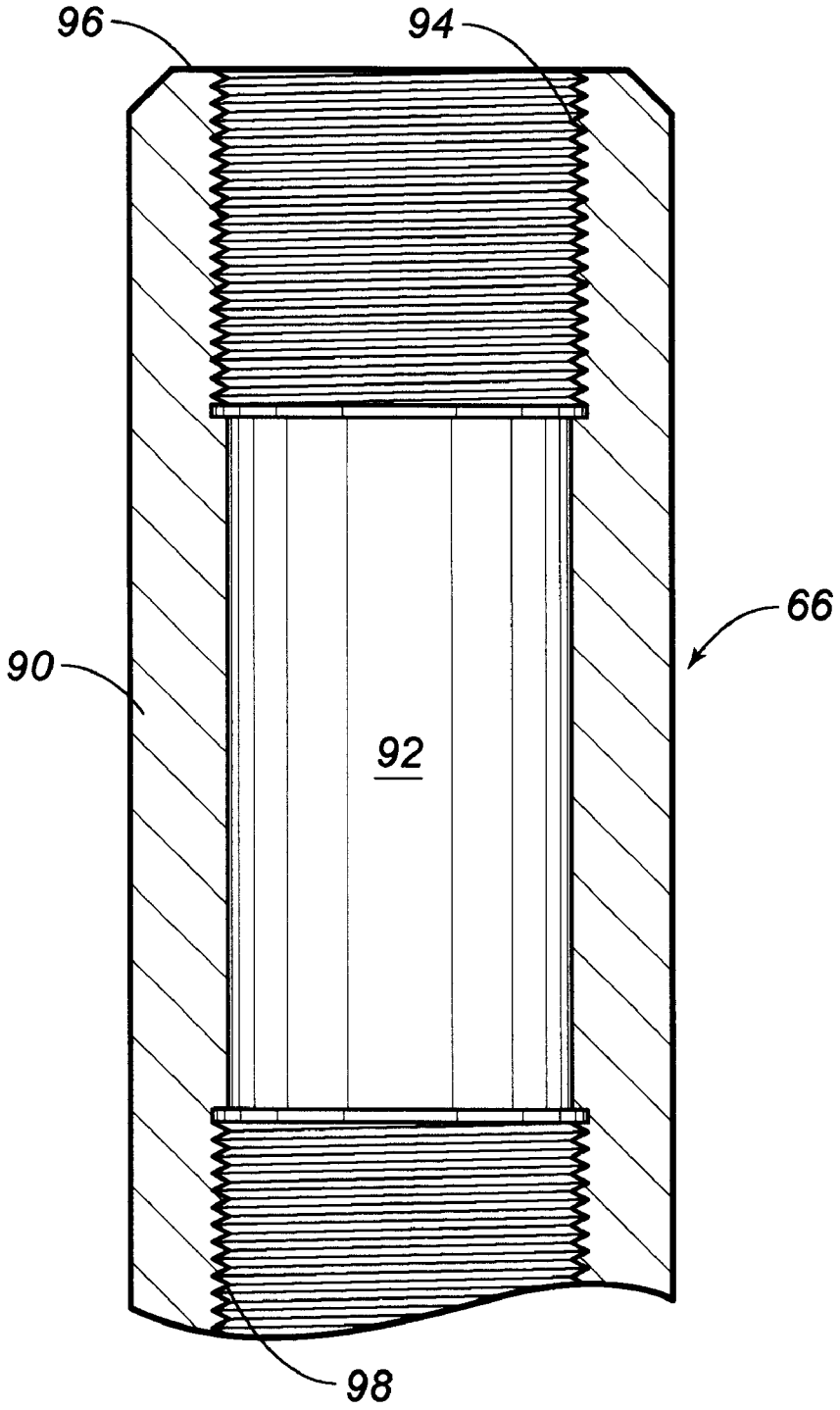
FIG. 4 is a cross-sectional view of a coupling as used between the insulating rod and the polish rod or as between the insulating rod and the sucker rod.

FIG. 4 shows an isolated view of the coupling 66. Coupling 66 is formed of a rigid steel material. The coupling 66 has a tubular body portion 90 lying in an interior passageway 92. An upper internally threaded area 94 is formed at the top end 96 of the coupling 66. Internally threaded area 94 is suitable for being joined to the externally threaded end of the polish rod 20. Similarly, the coupling 66 has a bottom internally threaded area 98 which is suitable for being joined to the upper externally threaded portion of the insulating rod 31.

The coupling 66 has a very similar configuration to that of the coupling 72. Coupling 72 is positioned between the insulating rod 31 and the sucker rod 10.

The foregoing description and disclosure of the present invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A pump apparatus comprising:

a pumping unit having a head thereon;

a polish rod connected to said head of said pumping unit and extending downwardly therefrom;

a tubing having a stuffing box through which said polish rod extends;

an insulating rod interconnected to a lower end of said polish rod and extending into said tubing; and a sucker rod string affixed to an end of said insulating rod opposite said polish rod, said sucker rod string extending through said tubing, said insulating rod having a thermal conductivity of less than said sucker rod string and said polish rod.

2. The apparatus of claim 1, said polish rod being a steel rod having a connector at a lower end thereof, said insulating rod having a connector at an upper end thereof, said connector of said polish rod being connected to said connector of said insulating rod.

3. The apparatus of claim 2, said connector of said polish rod having an externally threaded portion, said connector of said insulating rod having an externally threaded portion, the apparatus further comprising:

a coupling having an internally threaded area at an upper end thereof and an internally threaded area at a bottom end thereof, said internally threaded area at said upper end being affixed to said externally threaded portion of said polish rod, said internally threaded area of said bottom end being affixed to said externally threaded portion of said insulating rod.

4. The apparatus of claim 3, said insulating rod comprising:

a fiberglass body having steel connectors at respective opposite ends thereof, said externally threaded portion being on one of said steel connectors.

5. The apparatus of claim 1, said insulating rod having a thermal conductivity between 0.0167 to 0.06 BTU/(sq. ft.)(hr)(deg.F)(ft).

6. The apparatus of claim 4, further comprising another of said steel connectors having an externally threaded portion at a bottom of said insulating rod opposite said polish rod, said sucker rod string being affixed to said externally threaded portion at the bottom of said insulating rod.

7. The apparatus of claim 6, said sucker rod string having an externally threaded portion at an upper end thereof, the apparatus further comprising:

a sucker rod coupling having an upper internally threaded area joined to said externally threaded portion at the bottom of said insulating rod, said sucker rod coupling having a lower internally threaded area joined to said externally threaded portion of said sucker rod string.

8. The apparatus of claim 1, further comprising:

a downhole pump connected to an end of said sucker rod string opposite said insulating rod.

9. The apparatus of claim 1, said tubing having an exposed portion extending outwardly of a surface of the earth, the apparatus further comprising:

an insulating material affixed around said exposed portion, said insulating material having a thermal conductivity between 0.0167 to 0.06 BTU/(sq. ft.)(hr)(deg.F)(ft).

10. The apparatus of claim 9, said insulating material being a fiberglass wrapping.

11. An apparatus for reducing paraffin and asphaltene deposits in a pumping oil well comprising:

a polish rod having a portion extending outwardly of the earth and a portion extending into an oil string tubing;

a sucker rod string interconnected to said polish rod and extending through the oil string tubing into the earth; and an insulating rod interconnected to a lower end of said polish rod and interconnected to an upper end of said sucker rod, said insulating rod formed of a material having a thermal conductivity of between 0.0167 to 0.06 BTU/(sq. ft.)(hr)(deg.F)(ft).

12. The apparatus of claim 11, said insulating rod comprising at least one insulating rod having a length of less than 100 feet, said insulating rod comprising:

a body formed of a fiberglass material;

an upper connector affixed to said body and formed of a steel material; and a lower connector affixed to said body at an end opposite said upper connector, said lower connector formed of a steel material.

13. The apparatus of claim 12, said polish rod being a steel rod having a connector at a lower end thereof, said upper connector of said insulating rod being joined to said connector of said polish rod.

14. The apparatus of claim 13 said connector of said polish rod having an externally threaded portion, said connector of said insulating rod having an externally threaded portion, the apparatus further comprising:

a coupling having an internally threaded area at an upper end thereof and an internally threaded area at a bottom end thereof, said internally threaded area of said upper end being affixed to said externally threaded portion of said polish rod, said internally threaded portion of said bottom end being affixed to said externally threaded portion of said insulating rod.

15. The apparatus of claim 13, said sucker rod string having an externally threaded portion at an upper end thereof, the apparatus further comprising:

a sucker rod coupling having an upper internally threaded area joined to an externally threaded portion at the bottom of said insulating rod, said sucker rod coupling having a lower internally threaded area joined to said externally threaded portion of said sucker rod string.

16. The apparatus of claim 11, said oil string tubing having an exposed portion extending outwardly of the earth, the apparatus further comprising:

an insulating material affixed around said exposed portion, said insulating material having a thermal conductivity between 0.0167 to 0.06 BTU/(sq. ft.)(hr)(deg.F)(ft).

17. The apparatus of claim 16, said insulating material being a fiberglass wrapping.

18. A method of reducing paraffin and asphaltene deposits in pumping oil wells comprising:

forming an oil pumping unit having a polish rod connected to a head of a pump unit;

affixing an insulating rod to a bottom end of said polish rod within an oil string casing; and attaching a sucker rod string to an end of said insulating rod opposite said polish rod, said insulating rod having a thermal conductivity of less than said polish rod and said sucker rod string.

19. The method of claim 18, further comprising:

forming said insulating rod having a fiberglass body;

affixing a first steel connector to one end of said fiberglass body; and affixing a second steel connector to an opposite end of said fiberglass body, said fiberglass body having a thermal conductivity of between 0.0167 to 0.06 BTU/(sq. ft.)(hr)(deg.F)(ft).

20. The method of claim 18, said polish rod and said sucker rod string being formed of a steel material.

* * * * *